US006085570A

United States Patent [19]

Preaus

[11] Patent Number: 6,085,570

[45] Date of Patent: Jul. 11, 2000

[54] POWERED, PORTABLE, METAL BENDING APPARATUS

[76] Inventor: Paul E. Preaus, 3611 S. Jamestown, Tulsa, Okla. 74135

[21] Appl. No.: 09/465,330

[22] Filed: Dec. 17, 1999

[51] Int. Cl.[7] ..... B21D 9/05; B21J 13/02

[52] U.S. Cl. ..... 72/389.7; 72/389.6; 72/454; 100/257

[58] Field of Search ..... 72/389.3, 389.6, 72/454, 389.7; 100/214, 257

[56] References Cited

U.S. PATENT DOCUMENTS

| | | | |
|---|---|---|---|
| 2,098,548 | 11/1937 | Kick | 100/257 |
| 2,502,072 | 3/1950 | Bender | 100/257 |
| 3,283,699 | 11/1966 | Hawkins | 72/455 |
| 3,858,431 | 1/1975 | Miller | 72/455 |
| 4,242,903 | 1/1981 | Ledford et al. | 72/455 |
| 4,790,168 | 12/1988 | Vonthien | 72/389.7 |
| 5,661,994 | 9/1997 | Sundquist | 72/389.6 |
| 5,836,196 | 11/1998 | Smith | 72/384 |

*Primary Examiner*—David Jones
*Attorney, Agent, or Firm*—Frank L. Hart

[57] ABSTRACT

A powered, portable, metal bending apparatus has first and second end plates on opposed sides of a carrying element that is moveable along guiding members. A second surface of the first guiding member and the first surface of the carrying element have opposed first and second die parts adapted to bend metal strips therebetween in response to actuation of a mechanically actuated hydraulic jack which has an extendable length not greater than 8 inches and the construction of be apparatus adapted to weigh less than 50 pounds. The carrying element has arcuate corners and is nested between the guiding elements. The apparatus is designed to bend horticultural metal edging strips or other elongated metal elements to preselected angles of 90 degrees or less.

16 Claims, 6 Drawing Sheets

POWERED, PORTABLE, METAL BENDING APPARATUS

TECHNICAL FIELD OF THE INVENTION

The present invention relates to powered, metal bending apparatus. More particularly, the present invention relates to a powered, portable, metal bending apparatus that is of a construction sufficient for bending metal horticultural edging strips or other elongated members, for example pipe, via a mechanically actuated hydraulic jack.

BACKGROUND OF THE INVENTION

Metal horticultural edging strips, which are used to prevent grass from growing into flower beds and gardens, are of various forms, construction and weight. One type of these edging strips that is often used by professional landscaping companies is a heavy gage steel strip that is connectable to additional strips by metal spikes that are driven into the ground. These heavy gage metal strips are of sufficient strength to be driven into the ground by pounding on the top of the strips along its edge, but are of sufficient flexibility to be forced into gentle curves for forming a nonlinear edge.

In order to free-form the desired outline of a flower bed or garden, it is sometimes desirable to form the strip with a preselected sharp angle at a specific location on the strip. The principal angles that often required are angles of 90 degrees or less. These sharp angles are often required in defining the end portion of a flower bed which terminates adjacent a structure such as a house.

Heretofore, these angles were formed by beating the metal strips over an anvil until the desired configuration is achieved. This was very time consuming work, often marred the paint or finish of the metal edging strip, and many times represented waste of material when the metal strip was not securely maintained relative to the anvil during impact, thereby erroneously forming the bend.

In an effort to save time, material and expense, the subject inventor constructed a powered, portable bending apparatus which had the first and second end plates and rectangular carrying element that is slidably along guiding elements connecting the end plates one to the other. A hydraulic jack was positioned between the carrying element and the second end plate and adapted to move the carrying element toward and from the first end plate. The first end plate and carrying element included a respective die part, which die parts were nestable one within the other for bending a horticultural edging strip therebetween.

In this earlier version of this inventor's powered, portable bending apparatus, which was tested in actual commercial use for a period greater than one year prior to filing for a patent application, less than desirable bending of the metal strips was achieved. It was discovered that during bending of the strip, the carrying element sometimes moved to an orientation which was non-parallel to the first and second end plates. In this earlier version, the guiding elements passed through respective holes in the guiding element. This cocking or mis-alignment of the carrying element during bending operations caused unequal friction between the guiding element and the guiding members which resulted in chatter of the carrying element, movement of the metal strip relative to the dies during bending with resultant improper bend being formed, and unequal and mis-directed forces being placed on the metal strip, the hydraulic jack and the entire apparats.

In this earlier used construction, the guiding elements were welded to the end plates. The unequal forces undesirably stressed the weld connections. It was also discovered that this earlier version of the apparatus was undesirably cumbersome to pack and transport. The present invention is directed to overcoming one or more of these problems.

SUMMARY OF THE INVENTION

In one aspect of the invention, a powered, portable, metal bending apparatus is provided. The portable bending apparatus has first and second spaced apart end plates. Each of the end plates has a first and second surface and a plurality of symmetrically positioned openings extending therethrough. A rectangular carrying element is positioned between the end plates and has first and second surfaces and concave arcuate corners. A plurality of elongated guiding elements each have screw thread ends and an associated nut, said guiding members slidably nesting in a respective carrying member arcuate corner and said guiding member ends each pass through a respective opening of the end plates and connect one to the other with said accompanying nuts maintaining the guiding members to the end plates. A die has first and second die parts. The die first part is connectable to the second surface of the first end plate and the second die part is connectable to the first surface of the carrying element. The die parts are nettable one within the other. A hydraulic jack is positionable between the second end plate and the second surface of the carrying element. The hydraulic jack is adapted to move the second die part between a first position at which the die parts are spaced a preselected distance one from the other and a second position at which the die parts are nesting one within the other. The portable, metal bending apparatus has a weight in the range of about 15 to about 50 pounds.

DETAILED DESCRIPTION OF THE INVENTION

Best Mode for Carrying Out the Invention

Figure 1:
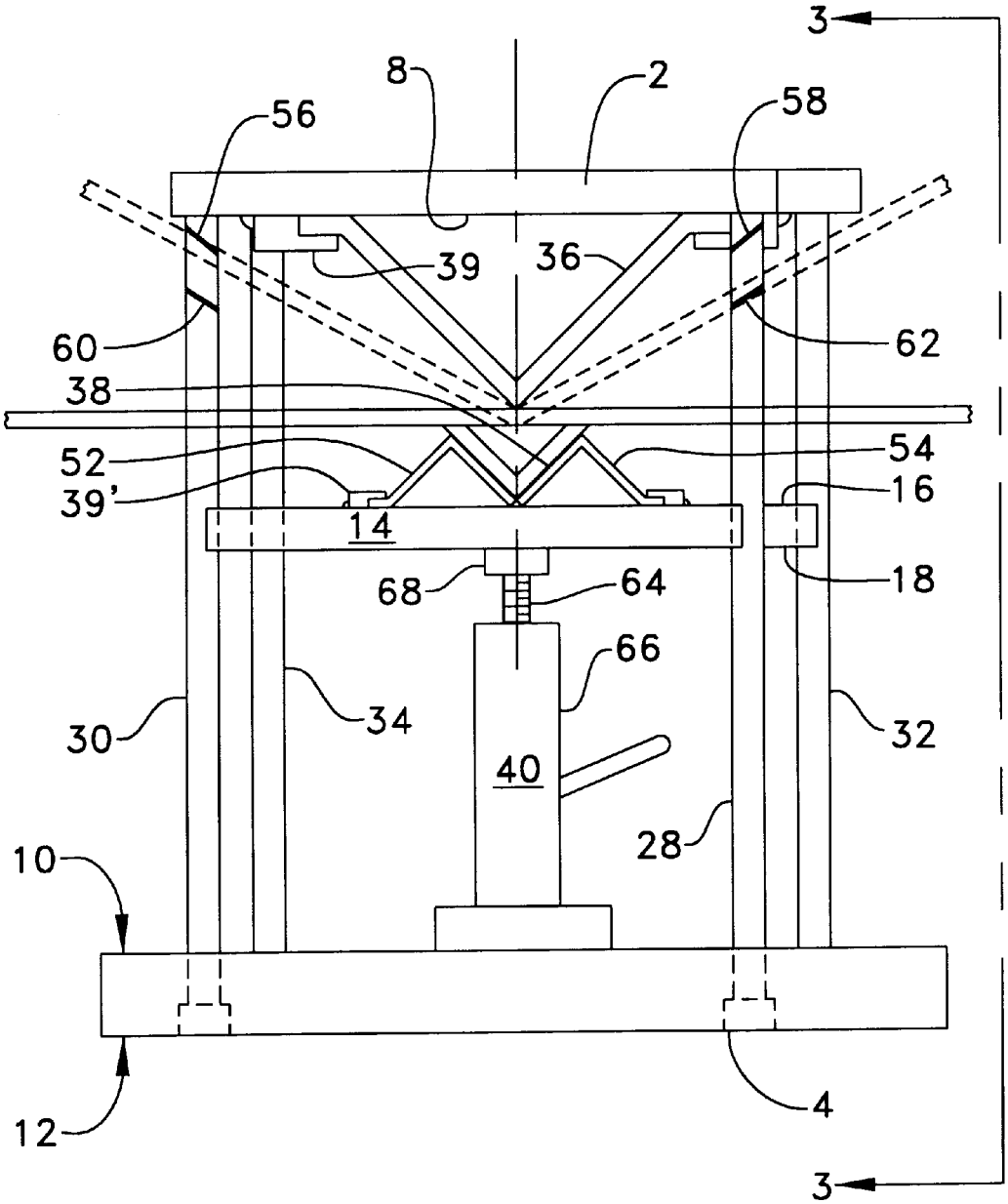
FIG. 1 is a diagrammatic angular frontal view of the apparatus of this invention.
Figure 2:
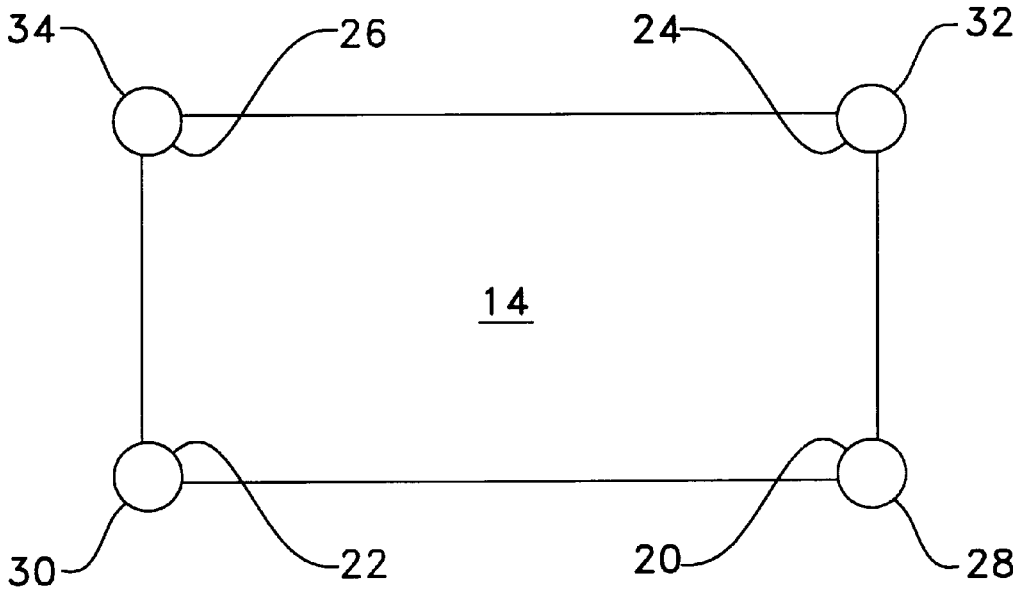
FIG. 2 is a diagrammatic top view of the carrying element of the apparatus of this invention with the associated die parts removed for simplicity.
Figure 3:
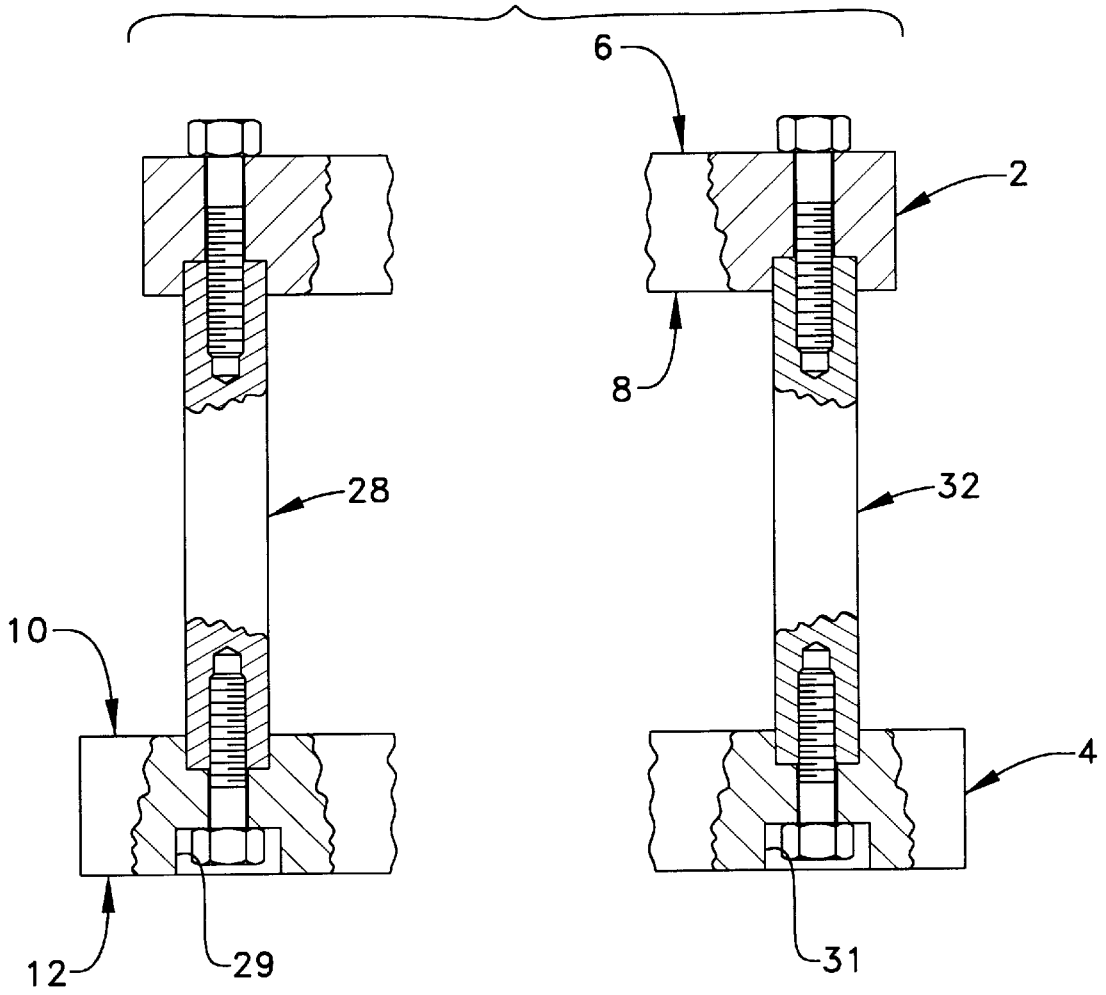
FIG. 3 is a diagrammatic side view of a portion of the apparatus of this invention showing the connection of the end pates by the guiding members.

Referring to FIGS. 1–3, the powered, portable, metal bending apparatus of this invention has flit and second spaced apart end plates 2,4. Each of the end plates 2,4 have respective first and second surfaces 6,8/10,12. The end plates 2,4 each have a plurality of symmetrically positioned openings extending therethrough.

A rectangular carrying element 14 is positioned between the first and second end plates 2,4. The carrying element 14, has first and second surfaces 16,18 and concave arcuate corners 20,22,24,26.

A plurality of elongated guiding members 28,30,32,34 connect the end plates 2,4 one to the other and are nested in a respective carrying element 14 arcuate corner 20,22,24,26. Referring specifically to FIG. 3, each of the guiding members 28,30,32,34 (only two shown for simplicity) have screw threaded ends and accompanying nuts, the carrying element 14 is trapped between the guiding members 28,30,32, 34 slidably pass along the guiding members 28,30,32,34 and the guiding member ends each pass through a respective opening of the end plates and connect one end plate 2 to the other end plate 4 with said accompanying nuts maintaining the guiding members 14 to the end plates 2,4.

A die of this invention has first and second die parts 36,38. The first die part 36 is connectable to the second surface 8 of the first end plate 2 and the second die part 38 is connectable to the first surface 16 of the carrying element 14. The die parts are oriented and of a configuration for nesting one within the other.

A hydraulic jack 40 is positionable between the second end plate 4 and the carrying element 14 and is adapted to move the second die part 38 and associated carrying element 14 between a first position at which the die parts are spaced a preselected distance one from the other and a second position at which the die parts are nesting one within the other.

The apparatus of this invention has a weight in the range of about 15 to about 50 pounds. Weights of the apparatus less than about 15 pounds will not be of sufficiently sturdy construction to bend heavy-weight horticultural metal edge strips without being deformed or breaking and therefore are undesirable. Weight of apparatus greater than about 50 pounds will represent a waste of materials and will be undesirably heavy for an operator to manually move between locations.

Referring to FIG. 3, the preferred method of connecting the end plates 2,4 to the guiding members 28,30 is shown. In this preferred method, the end portions of the guiding elements extend into a respective counter sunk opening 29,31 (only two shown for simplicity) of the end plates 2,4. By so providing tight fit counter sunk openings, the stability of the apparatus of this invention is increased.

Figure 4:
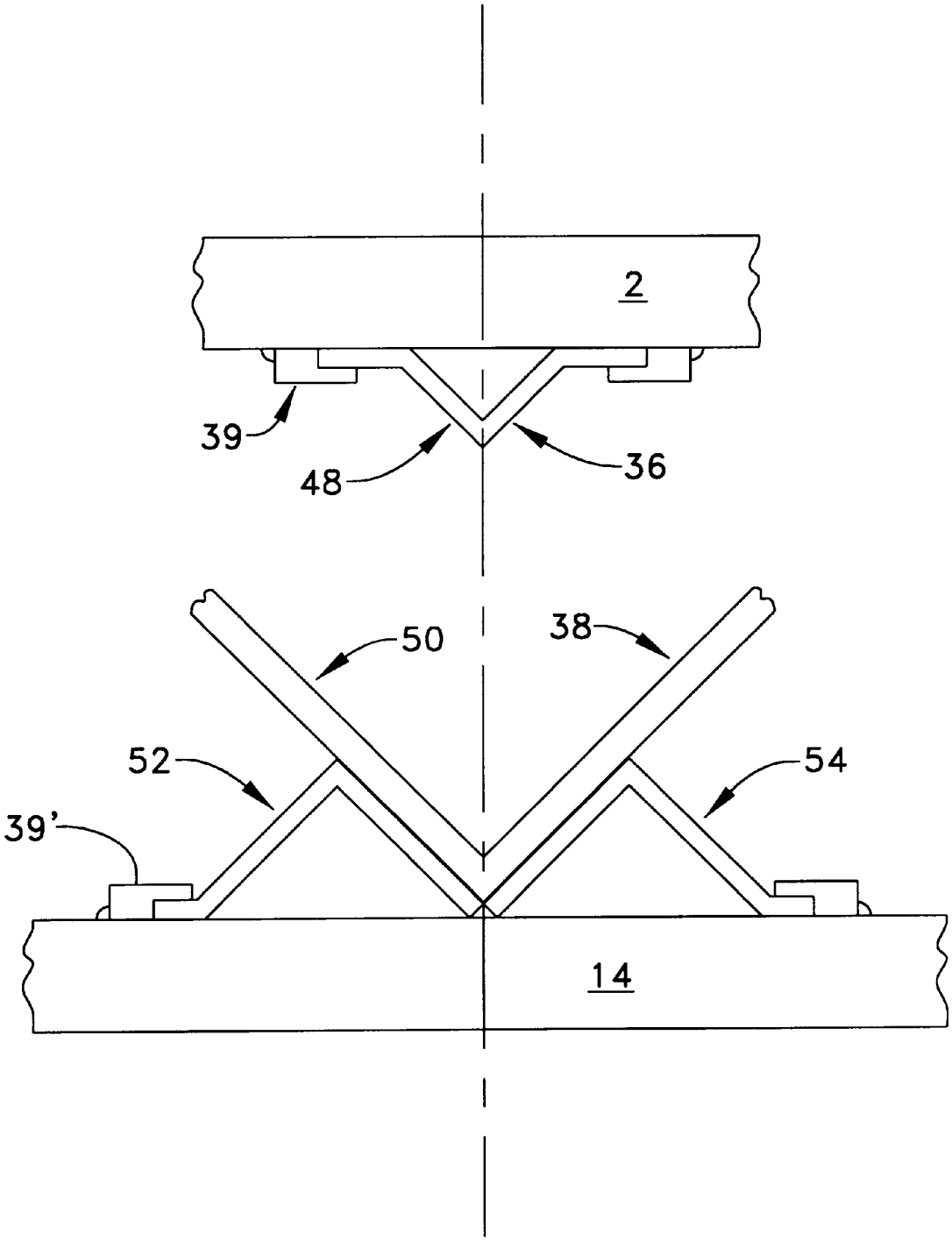
FIG. 4 is a diagrammatic partial view of the methods of connecting the die parts to the apparatus of this invention, one side of the die part showing the preferred method for a removable die part and the other side of the die part showing connection by welding.

The die parts 36,38, as shown in FIG. 4, are connected to their respective first end plate 2 and carrying element 14. In FIG. 4, the die parts 36,38 on the left side of the figure are shown connected by die part brackets 39,39' for preferably providing removable dies. On the right side of the figure, the die parts 36,38 are connected to their respective end plate 2 and carrying element 14 by welding. Removable dies are preferred where it may be desirable to change dies because of wear and tear or to provide different bending configurations.

In the embodiment shown in FIG. 4, the die parts 36,38 each have a respective metal forming surface 48,50 of general "V"' cross-sectional configuration with the legs of die parts defining an angle of 90 degrees. The first die part 36 is connected to the first end plate 2 at an orientation wherein the apex of the first die part 36 extends in a direction toward the second die part 38 and the second end plate 4. Since the die parts 36,38 nest one within the other, it naturally follows that the second die element's apex extends in a direction toward the second end plate 4. First and second supporting members 52,54, each being of general "V" cross-sectional configuration and a length greater than the width of a metal strip expected to be bent are fixed to the carrying element and in contact with and on respective opposed sides of the second die part 38 for maintaining the second die part 38 against movement responsive to the forces generated during metal bending.

It should be understood that the instant invention is not limited to the bending of horticultural edging strips. By using dies of different nesting configuration, the apparatus of the invention can be used to accurately bend various other elongated members.

It should be understood that the first and second die parts 36,38 can be differently oriented with their apex extending in an opposed direction without departing from this invention. However, the detailed description of orientation, as set forth above, is preferred since bending of a metal strip forces the ends toward the first end plate, or upwardly. If the alternative orientation is used and the bend is made a considerable distance from ends of the strip, the ends might contact the base or ground upon which the apparatus is sitting and undesirably deform the strip.

In the preferred embodiment of this invention, the first and second end plates 2,4 and carrying element each are of rectangular configuration, each have a center, and the die parts 36,38 are symmetrically position relative to said centers and the guiding members 28,30,32,34 are of general circular cross-sectional configuration and symmetrically positioned relative to said centers preferably each adjacent a respective corner of the first and second end plates 2,4 and carrying element 14. It should be understood that the end plates 2,4 and carrying element 14 can be of other than rectangular configuration and the plurality of guiding members 28,30,32,34 can be of a different number without departing from this invention. However, for relatively heavy duty bending of metal strips, the disclosed embodiment is preferred.

Figure 5:
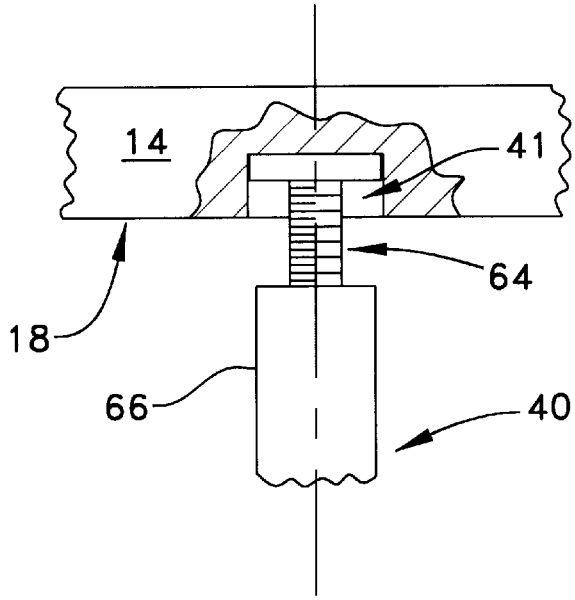
FIG. 5 is a diagrammatic partial view of the preferred method of centering and maintaining the hydraulic jack relative to the center of the carrying element.
Figure 6:
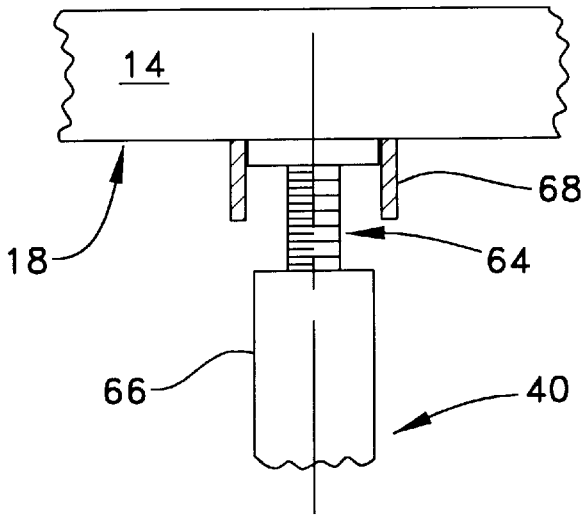
FIG. 6 is a diagrammatic partial view of another method of centering and maintaining the hydraulic jack relative to the center of the carrying element by welding tube 68 to the carrying element.

Referring to FIGS. 5 and 6, the hydraulic jack 40 has an extendable rod 64, and tube 66 as is well known in the art. The end of the rod 64 has a specific diameter and a center line. FIG. 6 shows the preferred embodiment wherein the rod end of the hydraulic jack is positionable within a counter sunk opening 41 on the second surface 18, of the carrying element 14. This counter sunk opening 41 is positioned at the center of the carrying element 14 and thereby assures that bending pressures from the jack 40 are centrally exerted relative to the die parts 36,38.

FIG. 6 shows another jack aligning apparatus where a centering tube 68 is connected to the center of the second surface 18 of the carrying element 14 and extends in a direction toward the second end plate 4. The centering tube has an inside diameter substantially the same dimension as the outside diameter of the end of the rod 64 of the hydraulic jack 40 and receives the end of the rod 64 in the installed position and the jack 40 is removably connected to the apparatus.

Figure 7:
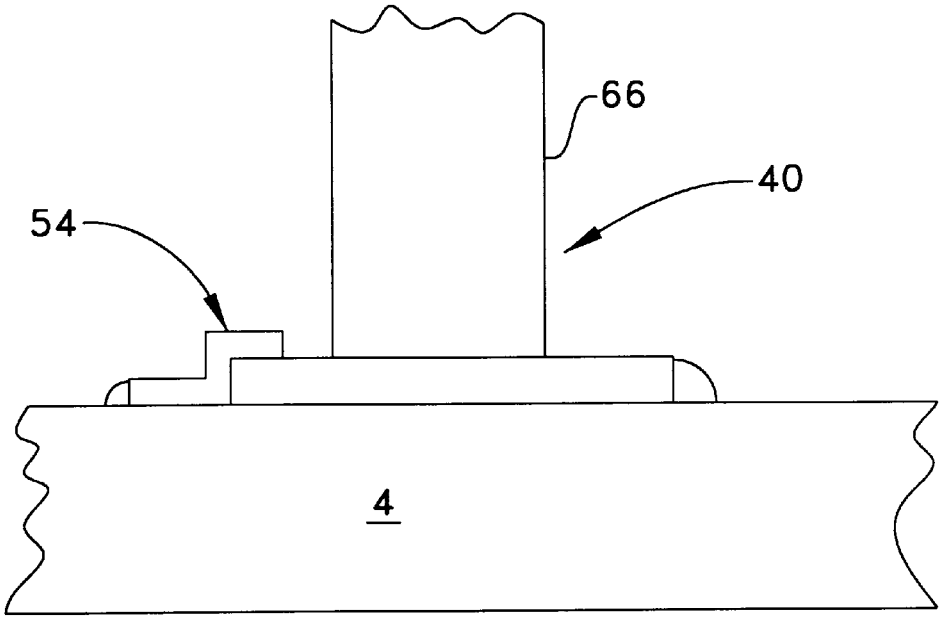
FIG. 7 is a diagrammatic partial view of the preferred method for connecting the hydraulic jack to the second end plate, one side of the jack showing the preferred connection method for a removable jack and the other side of the jack showing connection by welding.

Referring to FIG. 7, light weight hydraulic jacks 40, of the type utilized in this invention, wear out under continuous use, it is desirable to provide for replacement of the jack 40. In the embodiment shown in FIGS. 5 and 6, the jack 40 can be readily removed for ease in replacement, transportation and storage.

Figure 8:
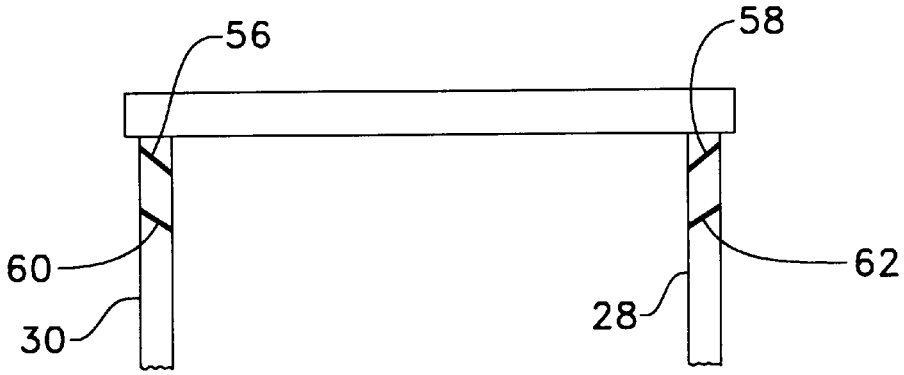
FIG. 8 is a diagrammatic enlarged view of the guiding members showing the gage marks of the guiding members.

Referring to FIG. 8, gage marks are positioned on selected guiding members which are aligned parallel with the metal strip being bent. The gage marks, for example 56 and 58 indicate that the metal strip has been bent to a 90 degree angle when the edges of the metal strip are aligned with these marks. The gage marks 60,62, for example will be used for indication of a 45 degree angle bend of the metal strip. Other gage marks indicating other degrees of bend can be on the guiding members without departing from this invention.

Industrial Applicability

In the operation of the apparatus of this invention, the apparatus is preferably placed on the ground or other base with the first end plate uppermost. A horticultural metal edging strip or other type elongated metal element desired to be bent, is inserted between the die parts 36,38 and linearly moved to the exact location at which the bend is desired. The hydraulic jack is then actuated to bend the metal strip or element to the desired angle as can be indicated by marks on guiding members. The rod of the jack is then lowered and the bent metal strip or element is removed.

As described in the detailed description, the carrying element can include a centering tube 68 or counter sunk opening for alignment of a removable jack.

By providing the carrying element in a nesting relationship, severe frictional problems are eliminated.

Other aspects, objects and advantages of this invention can be obtained from a study of the drawings, the disclosure and the appended claims.

What is claimed is:

1. A powered, portable, metal bending apparatus, comprising:

first and second spaced apart end plates, each having respective first and second surfaces, each having a plurality of symmetrically positioned openings extending therethrough;

a rectangular carrying element having first and second surfaces and corners of arcuate configuration;

a plurality of elongated guiding members each having screw threaded ends and an accompanying nuts, said guiding members slidably nesting in a respective carrying member arcuate corner and said guiding member ends each passing through a respective opening of the end plates and connecting one to the other with said accompanying nuts maintaining the guiding members to the end plates;

a die having first and second parts, said die first part being connectable to the second surface of the first end plate and said second die part being connectable to the first surface of the carrying element, said die parts being nestable one within the other; and a hydraulic jack positionable between the second end plate and the carrying element and being adapted to move the second die part between a first position at which the die parts are spaced a preselected distance one from the other and a second position at which the die parts are nesting one within the other, said apparatus having a weight in the range of about 15 to about 50 about pounds.

2. A powered, portable, metal bending apparatus, as set forth in claim 1, wherein the first die part is fixedly connected to the first surface of the first end plate and the second die part is fixedly connected to the first surface of the carrying element.

3. A powered, portable, metal bending apparatus, as set forth in claim 1, including means for removeably connecting the first die part to the first end plate and removeably connecting the second die part to the carrying element.

4. A powered, portable, metal bending apparatus, as set forth in claim 3, wherein the connecting means are brackets each extending over respective die parts and being fixedly connected to an associated one of the first end plate and carrying element.

5. A powered, portable, metal bending apparatus, as set forth in claim 1, wherein the die elements each have a metal forming surface of general "V" cross-sectional configuration.

6. A powered, portable, metal bending apparatus, as set forth in claim 5, wherein first and second legs of the die elements define an angle of about 90 degrees.

7. A powered, portable, metal bending apparatus, as set forth in claim 5, wherein said first die element is connectable to the first end plate at an orientation wherein an apex of the first die element extends in a direction toward the second die element.

8. A powered, portable, metal bending apparatus, as set forth in claim 1, wherein the first and second dies each have a preselected length substantially the same as the width of a metal strip to be bent by the apparatus.

9. A powered, portable, metal bending apparatus, as set forth in claim 1, including gage marks positioned on the guiding members at preselected locations and being adapted for alignment with a metal strip being bent, thereby indicating the degree of bending accomplished.

10. A powered, portable, metal bending apparatus, as set forth in claim 1, wherein the hydraulic jack has an extendable rod and a tube and the second surface of the carrying element includes a centering tube connected thereto at the center of the carrying element and extending in a direction toward the second end plate, said centering tube having an inside diameter substantially the same dimension as the outside diameter of the rod of the hydraulic jack.

11. A powered, portable metal bending apparatus, as set forth in claim 1, including a counter sunk opening on the second surface of the carrying element at the center of said carrying element, said counter sunk opening being of dimensions sufficient for receiving a rod end of the hydraulic jack and thereby assuring centering of the jack relative to said carrying element.

12. A powered, portable, metal bending apparatus, as set forth in claim 1, wherein the first and second die parts are welded to their respective first end plate and carrying element and including first and second supporting members each being of general "V" crossectional configuration and welded to the carrying element and in contact with and on respective opposed sides of the second die part.

13. A powered, portable, metal bending apparatus, as set forth in claim 1, including brackets connected to the first end plate and the carrying element and being adapted to receive the respective first die part thereof and removably maintain the respective die parts therewith.

14. A powered, portable, metal bending apparatus, as set forth in claim 1, wherein the guiding elements are each of circular crossectional configuration.

15. A powered, portable, metal bending apparatus, as set forth in claim 1, wherein the bending apparatus is of a construction sufficient for bending metal horticultural edging strips.

16. A powered, portable, metal bending apparatus, as set forth in claim 1, wherein the die parts at the first position are spaced apart not greater than one inch and the hydraulic jack is fixedly connected to the second end plate.

* * * * *